US005588882A

United States Patent [19]

Hung

[11] Patent Number: 5,588,882

[45] Date of Patent: Dec. 31, 1996

[54] WALL SOCKET WITH TWIST LOCK PRONGS

[75] Inventor: Ng Y. Hung, Kowloon, Hong Kong

[73] Assignee: Helms-Man Industrial Co., Ltd., Kowloon, Hong Kong

[21] Appl. No.: 431,050

[22] Filed: Apr. 28, 1995

[51] Int. Cl.[6] ..... H01R 13/415

[52] U.S. Cl. ..... 439/741

[58] Field of Search ..... 439/741, 870

[56] References Cited

U.S. PATENT DOCUMENTS

| | | | |
|---|---|---|---|
| 3,336,570 | 8/1967 | Tuchel | 439/697 |
| 3,348,191 | 10/1967 | Kinkaid | 439/741 |
| 3,530,422 | 9/1970 | Goodman | 439/741 |
| 3,833,879 | 9/1974 | Aidn et al. | 439/741 |

FOREIGN PATENT DOCUMENTS

| | | | |
|---|---|---|---|
| 996453 | 6/1965 | United Kingdom | 439/870 |
| 997204 | 7/1965 | United Kingdom | 439/870 |

*Primary Examiner*—Gary F. Paumen
*Attorney, Agent, or Firm*—Browdy and Neimark

[57] ABSTRACT

A system for fixing a prong (100) into a wall transformer housing (200) has a slot (202) through the wall into which the prong is mechanically inserted and fastened, rather than molded into place. The prong includes a body portion (101) for insertion into a wall socket, a neck portion (102) narrower than the body that is inserted into the housing slot, a head portion (104) that protrudes into the housing after the prong neck is inserted, and a twist portion (103) between the neck portion and the head portion having a reduced cross section so that the head can twist on the neck. The prong is inserted into the slot until the shoulder (the discontinuity of the neck and body cross sections) abuts the outer surface (212), the head may be twisted relative to the neck so that the chin (the underside of the head portion) rests on the inner surface. The neck portion is held firmly within the slot between the shoulder and the chin.

6 Claims, 1 Drawing Sheet

WALL SOCKET WITH TWIST LOCK PRONGS

FIELD OF THE INVENTION

The present invention relates to fastening metallic flat-blade electrical contact prongs into a electrical housing or "plug".

BACKGROUND OF THE INVENTION

Many electrical appliances use common line current which is supplied from electrical outlet sockets. The sockets accept a pair of flat blade-type prongs, each rectangular in cross section. The standard prongs are ¼ inch wide, slightly less than 1/16 inch thick, and almost ¾ of a inch long. The two prongs are set ½ inch apart on centers. Usually a hole for a third, grounding prong is provided. The grounding prong is usually round in cross section, instead of rectangular.

If the appliance is electrically isolated from the line current, as by a transformer or double insulation, then the third grounding prong is not necessary and only the two flat prongs need be provided and inserted into the socket for electrical powering of the appliance. Often the transformer is packaged in a small plastic box or housing, with low voltage wires (from the low side of the transformer) running from the box to the appliance proper. The transformer housing, rather than a jack or "plug" proper, then is placed directly against the socket when the prongs are inserted to power the appliance.

Such transformer housings are almost always molded of rubber or plastic insulating materials. The prongs need to be fastened to the box or housing in such a way that they are firmly held and that electrical contact path can be made to them inside the housing, after which the (usually two) mating parts of the housing are closed.

In the prior art, the conventional method of fastening prongs to transformer and other plug-type housings has been to mold them directly into the plastic. The housing mold has been provided with slots for accepting the prongs and holding them during the plastic injection. Because the prongs must protrude on both the outside and the inside of the housing for electrical connection, both the male and female halves of the mold required slots.

This method has several drawbacks. First, the mold is more expensive because of narrow slots that must be machined into it, and the provisions for inserting the prongs (if inserted from outside the mold). Second, the prong and its hole form a leakage point for molten plastic, and can result in flash that covers the prong surfaces to interfere with electrical contact, spoil the housing appearance, and, during soldering of leads to the inside ends of the prongs, burn and give off fumes. Third, the molding operation is more difficult and slower because the mold must be opened wide to release the housing with its prongs, the prongs require time for insertion, and so on. Fourth, the differential temperature expansion coefficients of metal prongs and plastic housing may cause problems while injecting hot plastic or during cooling.

SUMMARY OF THE INVENTION

Accordingly, the present invention has an object, among others, to overcome deficiencies in the prior art such as noted above.

The invention thus provides a prong structure and method of attaching prongs to a housing to form a plug in such a manner which reduces mold expense, cuts molding cycle time, and improves mechanical strength.

Instead of molding a plastic housing with the prongs in the mold, the method of the present invention provides slots in the molded housing that accept the prongs after the housing is molded and cooled.

Each prong includes a body portion having the standard dimensions needed for insertion into a wall socket. At the point where the body is to meet the outer surface of the housing, the prong narrows at a shoulder to form a neck that is inserted into the slot of the housing and fits there snugly. At the end of the neck, adjacent the inner surface of the housing when the neck is fully inserted into the slot, is a twist portion, of reduced width, that separates the neck from the head of the prong. The twist portion lies between the neck and the head of the prong, and has adjacent its width opposing ledges or abutment surfaces on the neck and head. The head protrudes from the inner surface of the housing when the neck is fully inserted. After insertion, the head is twisted so that underside or abutment surfaces of the head, hereafter called the chin surfaces, rest against the inner surface of the housing.

Thus, after insertion and twisting, the prong is held longitudinally between the shoulder and the chin. The prong is also held against rocking and rotating about its length by the snug fit of the neck in the housing slot.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Figure 1:
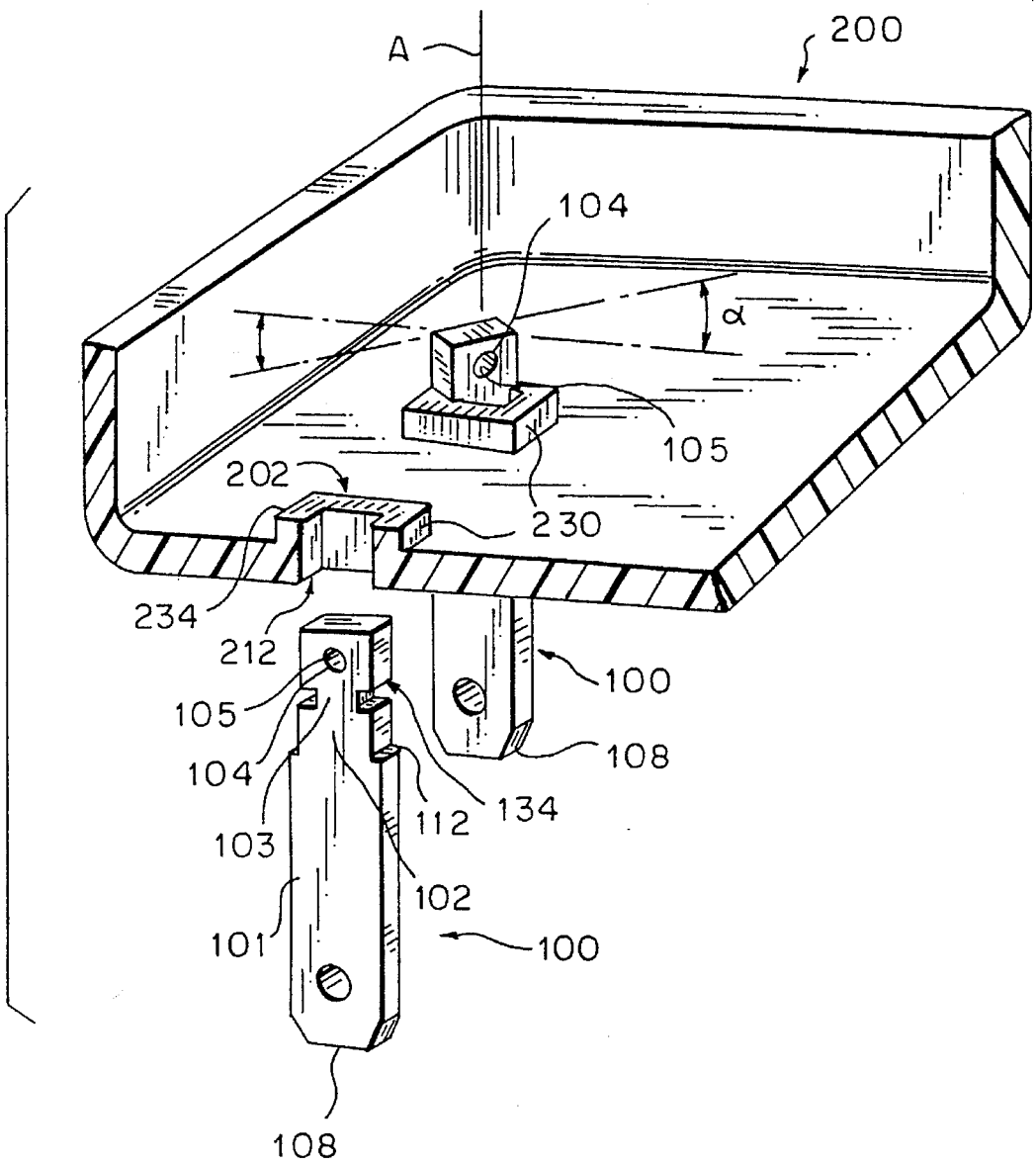
FIG. 1 is a partially exploded perspective view of the invention.

The present invention relates to an electrical contact prong, an insulating housing, and a system for combining them to form an electrical "plug" for insertion into a common wall socket carrying regular line current. FIG. 1 is a perspective partially exploded overview of the invention showing one prong 100 inserted and a second prong 100 not yet inserted into a housing 200.

The housing 200 will generally be formed of injection molded plastic, phenolic resin, hard rubber, ceramic or other non-conductive material. FIG. 1 shows one half of a housing, which can be mated with a second portion (not shown) of the housing to enclose electrical parts. The complete housing with both prongs 100 attached would be "plugged in" to a wall socket. A transformer in the housing 200 might be used to produce electricity at lower voltage than line voltage to be sent out through a wire to the appliance. The housing 200 may alternatively be a simple electrical line plug for power supply to an electrical appliance, etc.

The prongs 100 are metallic so as to conduct electricity from the wall socket into the housing to provide line current to the transformer primary. The prongs 100 may be for example formed of copper plated with nickel. The two prongs 100 are preferably identical. For example, when the housing 200 is for a transformer, the prongs 100 are connected across a transformer which has no direct connection to the appliance, no ground prong is required, the plug is not polarized, and the two prongs may be identical.

As best seen in FIG. 1, the prong includes a main body portion 101 which serves as the electrical contact in the wall socket; a neck portion 102 which is preferably narrower, but not thinner, than the body portion 101; and a head portion 104 which is preferably the same size in cross-section as the neck portion 102. The head portion 104 may also be somewhat smaller than the neck portion 102. A twist portion 103, located between the neck portion 102 and the head portion 104, is preferably substantially narrower than either the neck portion 102 or the head portion 104, so that if the prong 100 is twisted by turning the head portion 104 relative to the remainder of the prong 100, deformation will occur at the twist portion 103 rather than elsewhere. Thus the head 104 may be turned about the neck 102 without twisting the neck 102 about the body portion 101.

The approximate preferred dimensions of the body portion, in inches, are ¼ by 3/64 by ⅝.

Neck portion 102, twist portion 103, and head portion 104 together comprise a shank which is inserted through a slot 202 of the housing 200. When inserted the prong 100 should be held firmly. Thus, the cross-sectional dimensions of the slot 202 should be nearly identical to the cross-sectional dimensions of the neck portion 102 of the prong 100. The head portion 104 may be no greater in width and thickness than that of the neck portion 102, else the shank could not be inserted.

An abrupt difference in cross-section between the body portion 101 and the neck portion 102 creates a first ledge or shoulder 112 which faces away from the distal tip or free end 108 of the prong 100 toward the head 104, and which, when the prong 100 is fully inserted into the slot 202, rests against an outer surface 212 of the housing 200. The depth of the slot 202 is equal to the distance from the shoulder 112 to a second ledge 134 formed by the other discontinuity in cross-section between the twist portion 103 and the head portion 104. This second ledge 134 is herein called a chin, and it serves to lock the prong 100 into the slot 202.

FIG. 1 shows one of the prongs 100 inserted and locked by such twisting, about an axis A, through an angle α. The axis A is generally parallel to the length of the prong 100 and perpendicular to the inner surface of the housing 200, or, to the inner surface of a raised boss 230 on the interior of the housing 200.

After insertion of the prong 100, twisting the twist portion 103 brings the chin or second ledge 134 into contact with the inner surface 234 of the housing 200. This prevents the prong 100 from pulling out, as the chin 134 and the shoulder 112 together prevent all lengthwise motion of the prong 100.

The twisting of the head 104 relative to the neck 102 may be accomplished by any means, such as automatic machinery or manual twisting with a pliers. Electrical wire leads may then be connected to the heads 104 in any suitable way, e.g., by soldering, clamping, etc. Holes 105 in the head portions 104 are provided for such connection.

Figure 2:
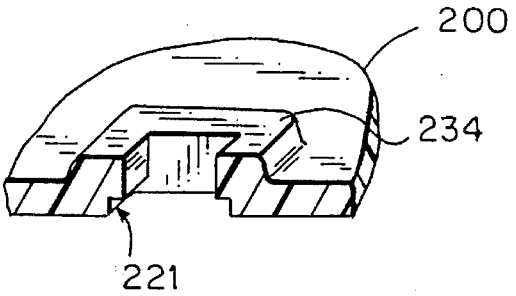
FIG. 2 is perspective view of an alternate embodiment of the housing slot.

FIG. 2 shows an alternate embodiment of the outer surface 212 of the housing 200. In this alternative embodiment a step 221 is provided against which the shoulder 112 may rest. The body 101 is thus partially inserted below the level outer surface of the housing 200.

It will be understood that the example of a transformer housing does not limit the invention to use with transformers or transformer-type housings. In general, the foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A system for fixing an electrical contact prong through a housing wall such that the prong may conduct electricity through the housing wall, comprising:

a slot in the housing wall having a generally constant rectangular slot cross section, the slot passing through the wall from a housing outer surface of the housing wall to a housing inner surface of the wall, the outer surface of the housing wall and the inner surface being separated by a thickness of said wall; and an elongated prong having a length and further comprising a main body portion for making electrical contact outside the housing and having a body cross section larger than the slot cross section in at least one dimension, a neck portion disposed along the length of the prong adjacent the body portion and having a generally rectangular neck cross section substantially equal to the slot cross section, a head portion, disposed along the length of the prong adjacent the neck portion and distal the body portion, the head portion having a head cross section no larger than the neck cross section such that the head portion may pass through the slot, and a twist portion disposed along the length of the prong intermediate the neck portion and the head portion and having a twist cross section substantially less in area than the head cross section, such that the twist portion is weaker in torsion along the length of the prong than other portions of the prong;

a shoulder formed by a first cross-sectional discontinuity of the neck cross section and the body cross section;

a chin formed by a second cross-sectional discontinuity of the twist portion and the head portion;

a distance from the shoulder to the chin being substantially equal to the thickness of said wall;

whereby when the prong is inserted into the slot, the shoulder abuts the outer surface of the housing, the head may be twisted relative to the neck about the length of the prong so that the chin abuts the inner surface of the housing, such that the neck portion is held firmly within the slot between the shoulder and the chin.

2. The system according to claim 1, wherein the outer surface is recessed into an outside surface of the housing.

3. The system according to claim 1, wherein the head portion includes a hole for passing a wire therethrough to make electrical contact.

4. The system according to claim 1, wherein the inner surface is on a raised internal boss of the housing.

5. The system according to claim 1, wherein the body cross section is a rectangle measuring approximately ¼ inch wide by approximately 3/64 inch thick and the body portion is approximately ⅝ inch long, whereby the body portion of the prong is adapted to fit into a standard electrical outlet socket.

6. The system according to claim 5, wherein the system includes a pair of the prongs and a corresponding pair of the slots.

* * * * *